US005177981A

United States Patent [19]

Haas

[11] Patent Number: 5,177,981

[45] Date of Patent: Jan. 12, 1993

[54] DRINK COOLER

[76] Inventor: Raymond Haas, 9120 Hillside Trail So., Cottage Grove, Minn. 55016

[21] Appl. No.: 760,706

[22] Filed: Sep. 16, 1991

[51] Int. Cl.[5] ..... F25D 11/00; F25D 3/08

[52] U.S. Cl. ..... 62/457.3; 62/1

[58] Field of Search ..... 62/59, 457.1, 457.2, 62/457.3, 457.4, 529, 459, 463, 465, 466, 1

[56] References Cited

U.S. PATENT DOCUMENTS

| | | | |
|---|---|---|---|
| 929,389 | 7/1909 | Clement | 62/457.3 |
| 1,393,235 | 10/1921 | Mitrovich | 62/457 |
| 1,519,034 | 12/1924 | Livingston | 62/457.3 |
| 1,721,311 | 7/1929 | Muenchen | 220/428 |
| 2,048,041 | 7/1936 | Warren et al. | 62/457.3 |
| 2,550,633 | 4/1951 | Zalkind | 62/59 |
| 2,734,358 | 2/1956 | Himmelfarb | 62/142 |
| 2,738,890 | 3/1956 | Dahl et al. | 215/6 |
| 2,895,636 | 7/1959 | Martin | 220/15 |
| 2,952,133 | 9/1960 | Miller | 62/457.3 |
| 3,359,759 | 12/1967 | Mirguet | 62/457.1 |
| 3,550,803 | 12/1970 | Pelli | 215/12 |
| 3,810,557 | 5/1974 | Cline | 215/12 |
| 4,485,636 | 12/1989 | Hilado | 62/430 |
| 4,625,518 | 12/1986 | Freedman | 62/1 |
| 4,928,848 | 5/1990 | Ballaway | 220/444 |
| 5,009,083 | 4/1991 | Spinos et al. | 62/400 |

FOREIGN PATENT DOCUMENTS

| | | | |
|---|---|---|---|
| 2652061 | 5/1978 | Fed. Rep. of Germany | 62/457.3 |

*Primary Examiner*—ALbert J. Makay
*Assistant Examiner*—William C. Doerrler
*Attorney, Agent, or Firm*—Jacobson & Johnson

[57] ABSTRACT

A drink cooler to keep liquids cool, the cooler having three parts, a lid, a frusto-conical outer container and a resilient plastic bottle which when placed inside a container having a radily inward protrusion creates an annular cavity for which water can be poured into and frozen without breaking the glass, and after freezing, the resilient bottle may be removed to allow the outer container to function as a glass with one annular ice ring located around the inside of the outer container.

11 Claims, 2 Drawing Sheets

DRINK COOLER

FIELD OF THE INVENTION

This invention relates generally to glasses for cooling drinks, and, more specifically to glasses which have an ice formation attached to the glass.

BACKGROUND OF THE INVENTION

In the field of keeping drinks cool simply and inexpensively, there are several annoying problems. For example, when a user drinks from a glass with ice cubes, the ice cubes float up and strike the user in the lips and mouth, also, when the drink is almost finished, the ice cubes often stick together at the bottom of the glass, and when the glass is lifted to allow the user to drink the remaining liquid, the ice cubes suddenly cascade down the glass causing both embarrassment and spillage. Another disadvantage of ice cubes are that, unless you have an automatic ice cube maker, purchasing the ice cubes can become expensive. Another disadvantage is that ice cubes can be very noisy and clunky when they float around in a glass and hit the sides.

Still other devices use double walled containers with a freezable liquid located inside the double walls. A disadvantage is in the field of safety, for example many thermos devices and double walled cooling devices contain harmful chemical refrigerants, which make them unsuitable for use if a crack or leak develops in the glass. Another disadvantage of double walled cooling devices is that the drinks are often primarily cooled by conduction through a wall, which is an inferior method of keeping drinks cool compared to direct conduction between the ice cubes and the liquid in the drink. Another disadvantage of double walled vacuum devices is that they cannot be used to cool something down, they may only be used to insulate.

An object of this invention is to make and keep drinks cool in a glass.

Another object of this invention is to do away with slippery, messy ice cubes.

Another object of this invention is to provide a glass which is tapered at the top, so as to prevent the ice from rising and hitting the user in the mouth.

Another object of this invention is to provide an inexpensive way of making and keeping drinks cold because ice cubes will no longer have to be purchased.

Another object of this invention is to do away with dangerous chemical refrigerants, and therefore provide a safe drink cooling device that even children can use.

Another object of this invention is to provide a drink cooler that cools the drinks by direct contact of the liquid and the ice.

DESCRIPTION OF THE PRIOR ART

U.S. Pat. No. 4,485,636 is a double-walled refrigeration container which uses a diaphragm to accommodate the expansion of the fluid.

U.S. Pat. No. 4,928,848 is a combination cup holder and drinking vessel which accommodates different sized cups.

U.S. Pat. No. 5,009,083 is a beverage cooler having two walls with a refrigerant between the two walls to cool the beverage as it is withdrawn from the cooler.

U.S. Pat. No. 2,895,636 describes a double-walled cooler with a vacuum between the double walls.

U.S. Pat. No. 3,550,803 describes a double walled cosmetics container.

U.S. Pat. No. 3,810,557 describes a double walled beverage cooler where water is poured in between the two walls and then frozen. The ice does not come into contact with the liquid in the glass.

U.S. Pat. No. 2,738,890 is a double walled container which uses refrigerant to keep liquids, primarily medicine, cold.

U.S. Pat. No. 2,734,358 comprises an outer beverage holder container and an inner ice holding container.

U.S. Pat. No. 1,721,311 refers to a refrigerating vessel which has a double walled container and a vacuum space.

U.S. Pat. No. 1,393,235 refers to a double-walled shrimp cooler and server wherein ice is placed between the outer and inner walls.

BRIEF SUMMARY OF THE INVENTION

A device used for cooling drinks comprising an inner deformable and resilient bottle that when placed inside of a drinking glass forms an annular cavity for liquid, such as water, to be poured. The glass is covered by a lid with a large hole and several small holes, the large hole for the inner bottle to fit through and the small holes for air to pass throughout the device. When water located in the annular cavity is frozen the inner bottle deforms, yielding to the building pressure, thus preventing breakage of the glass. The inner bottle is of sufficient strength so as not to allow the water pressure to collapse the bottle prior to freezing.

DESCRIPTION OF THE PREFERRED EMBODIMENT

Figure 1:
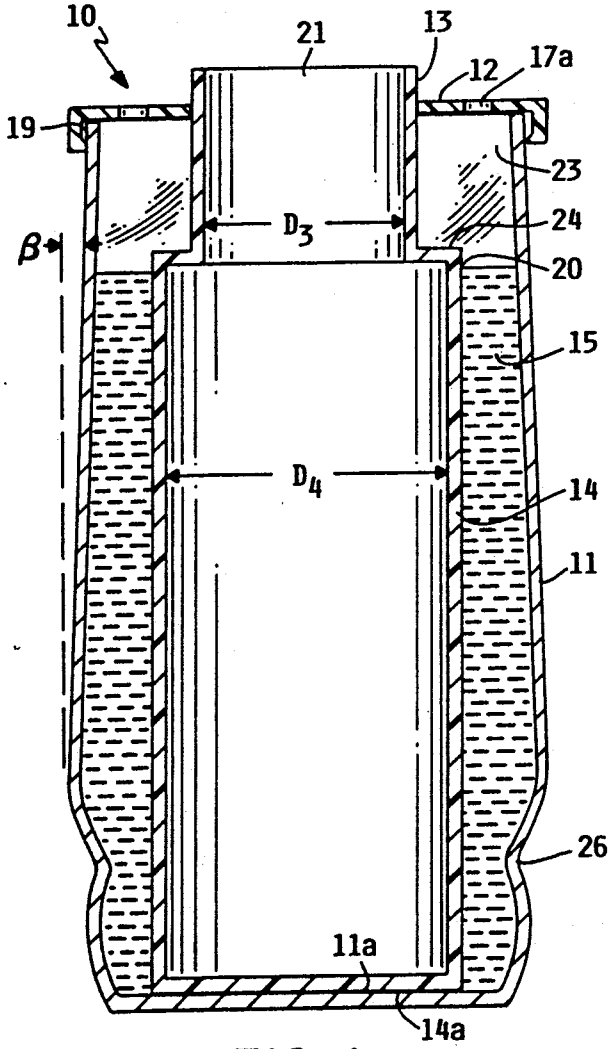
FIG. 1 is a cross cut sectional view of the drink cooler.

FIG. 1 illustrates the drink cooler 10 which is comprised of three different pieces, an outer frusto-conical shaped glass 11, a pliable, deformable and resilient plastic inner bottle 14, and a cooler lid 12. The annular space between inner bottle 14 and glass 11 is filled with water 15 up to level marker 20 on the side of bottle 14. Inner bottle 14 is cylindrical having a lower section with width $D_4$ from the bottom of glass 11 until just above level marker 20, where the narrower neck is designated by $D_3$. A shoulder 24 connects the inner bottle top 13 to lower section of inner bottle 14. After lid 12 is placed on glass 11, a cylindrical inner bottle top 13 protrudes through a hole 18 in the middle of lid 12. A friction fit between opening 18 in lid 12 and neck 13 holds bottle 14 in position when water 15 is in glass 11. Lid 12 includes an annular side 16 with an ear **16*a* for forming pressure engagement with the side of glass 11 to hold lid 12 in place on glass 11. That is, lid 12 forms a slight interference fit on the top edge 19 of glass 11 to hold lid 12 on glass 11**.

In operation of my device the annular region between glass 11 and bottle 14 is filled with water to line 20. Next cooler 10 is placed in a freezer. As water 15 begins to freeze, inner bottle 14 deforms inward in response to the pressure since it is sufficiently pliable to allow water to freeze and expand without breaking glass 11, yet sufficiently stable enough to prevent collapse altogether. After water 15 has frozen, lid 12 and inner bottle 14 are removed, forming a central cavity where a warm drink can be placed and subsequently cooled by an annular ice ring 15. Notice that on the top portion of glass 11 is a frusto-conical tapered section showing that glass 11 has an inward taper of angle $\beta$ which acts to prevent frozen water 15 from floating or sliding upwards into a users face. Also acting to achieve the same effect is the circular groove 26 at bottom of glass 11 which water 15 freezes around thus preventing upward slippage. Notice also a lip clearance area 23 around the top of the glass, which provides between 1¼ and 1½ inches of glass where ice 15 is not located, thus providing ample room for a user to place their lips on edge of glass 11 without contacting ice 15.

Figure 2:
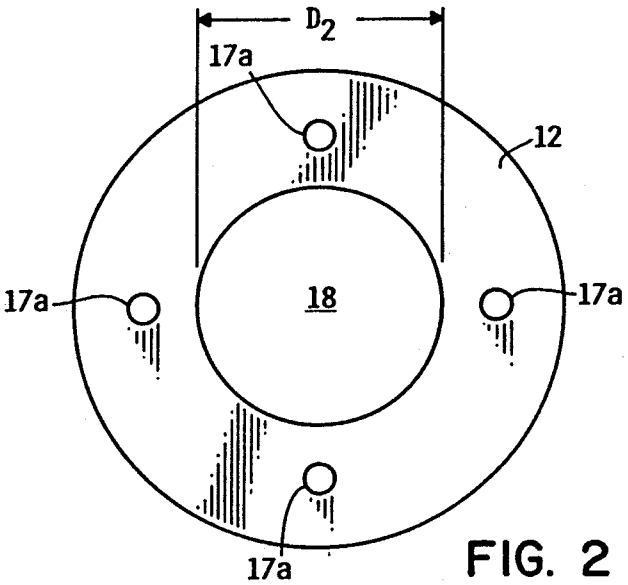
FIG. 2 is a top view of the drink cooler illustrating a lid securely fastened.

FIG. 2 is a top view of cooler 10. Lid 12 contains small holes 17*a* which allow air into and out of cooler 10 as the water expands as it freezes. In addition the holes in the lid allow a user to pour water into the glass to fill the glass to the proper level when the cover is on Large hole 18 width $D_2$ is cut from lid 12 so that inner bottle top 13 may form a frictional fit therein. In an alternate embodiment I can provide a recess around the neck of bottle 13 to permit the lid to engage the bottle and prevent the bottle from floating up as water is poured into the glass.

Figure 3:
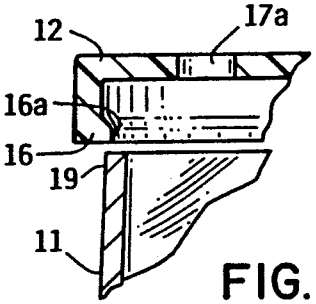
FIG. 3 is a side sectional view of the drink cooler showing a lid about to be fastened.

FIG. 3 is a partial side view cut-away of the top portion of cooler 10. This view illustrates friction ring or lip 16*a* which frictionally holds lid 12 to top of glass 11. Also shown are small holes 17*a* which allow air into and out of glass 11 when lid 12 is secured in place.

Figure 4:
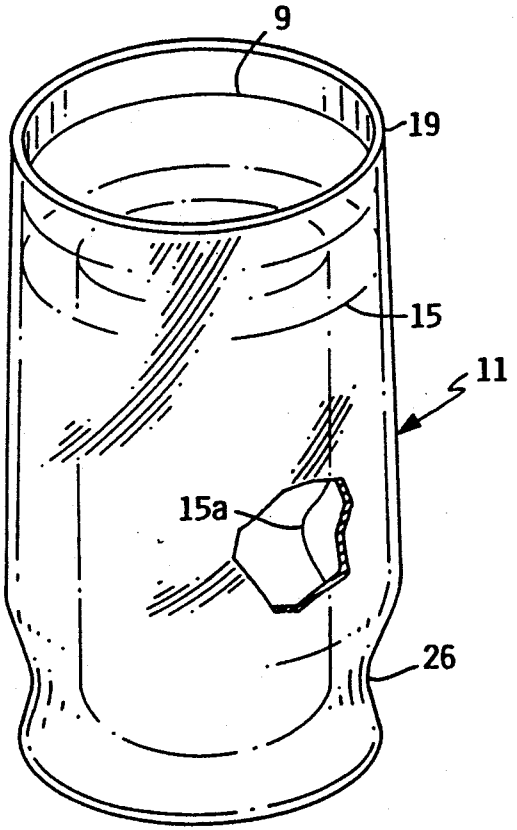
FIG. 4 is a pictorial view of drink cooler after being frozen with a lid and inner bottle removed.

FIG. 4 is a pictorial view of cooler 10. In this representation, water 15 has been frozen in cylindrical shape inside glass 11 and water 9 has been placed in the glass. Note ice 15 is not able to move upwards because of frusto-conical tapered section 19. I have found that a few degrees of taper is sufficient to keep the ice from floating up with a drink that sits for an hour or more.

Figure 5:
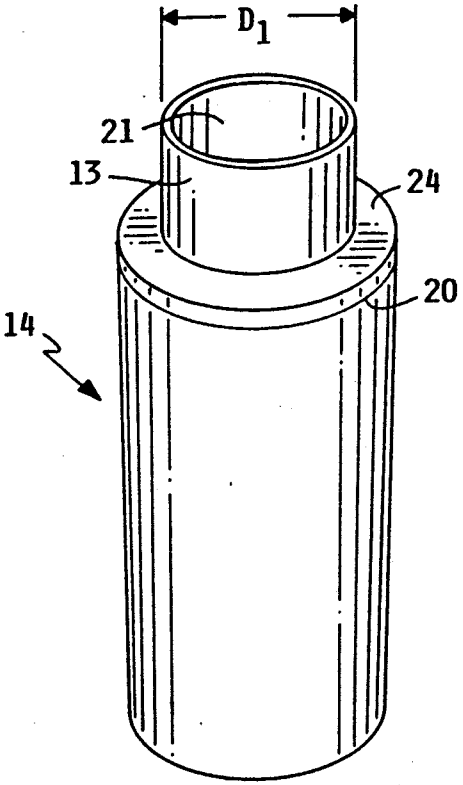
FIG. 5 is a full pictorial view of the drink cooler with the inner bottle and the lid in place.

FIG. 5 is a pictorial view of the deformable and resilient bottle 14 ready to be placed in freezer. Typically, deformable bottle 14 is made of a material such as polyethylene. Note that the width of the top of bottle $D_1$ allows for a snug frictional fit through opening 18 having a width $D_2$. Also note that the inner bottle top 13 is hollow having an opening 21 allowing for equalized pressures between the inside and outside of cooler 10 while cooler 10 is being frozen. Reference numeral 15*a* identifies a protrusion from the annular ice ring 15. That is, as water freezes it may bend the deformable bottle 14 inward thus avoiding the breaking of glass 11. The purpose of opening 21 is to allow one to free bottle 14 from the ice in the event an ice protrusion is formed on ice ring 15. If the deformable bottle 14 should stick on a protrusion from the annular ice ring in the glass, one can pour warm water into bottle 14 through hole 21 thus allowing the bottle to be quickly removed from the annular ice ring.

In the process of insitu forming ice on the inside wall of a container includes the steps of placing a removable member such as a resilient plastic bottle 14 in a container such as a drinking glass 11 to form an annular compartment for freezing water. Next one pours water into the annular compartment to partially fill the compartment with water. Next one freezes the water in the compartment to form a layer of ice on the inside wall of the container. After forming the ice on the wall of the container one removes the bottle from the container to thereby form a cavity for holding a liquid in direct contact with the ice in the container as the ice dissolves into the liquid to cool the liquid. In the event the bottle should stick to the ice the user can pour a warm liquid into the bottle to thereby thaw the ice around the exterior of the bottle to free the bottle from the ice located in the container. In order to prevent the ice in the glass from floating upward I form a protrusion in the compartment. The protrusion can result from an inward taper on the container, a ring around the container or it can result from the coaction of the water as it freezes in the compartment. That is if a non deformable interior member is used in an unbreakable exterior container, which expands under pressure from the water freezing the ice will tightly contact the inside of the unbreakable container to hold the ice in place. In this arrangement the pressure coaction of the container and the ice reduce the tendency of the ice formed in the compartment to float up when a liquid is placed into the compartment.

Figure 6:
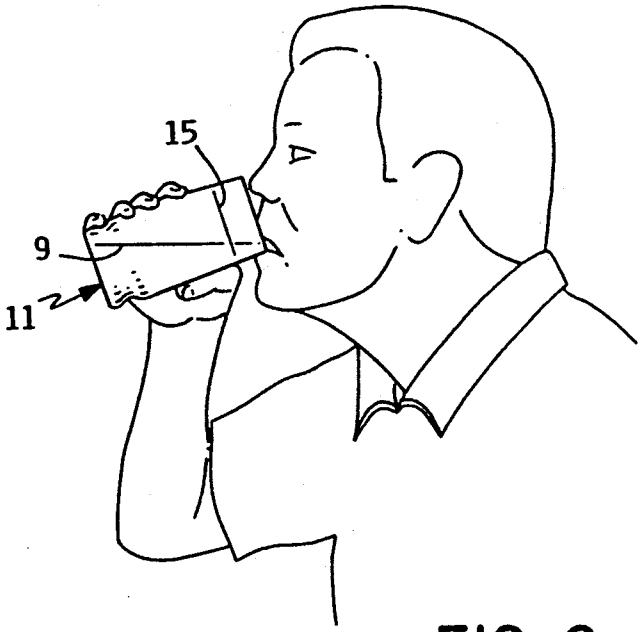
FIG. 6 shows a person drinking from a glass containing an annular ice chunk.

FIG. 6 is a pictorial view of a user consuming a liquid 9 from glass 11 which is kept cool by an annular ice ring 15. Notice how ice ring 15 remains in position on the glass while liquid 9 flows over ice 15 to the users lips.

As a variation of my invention, a container such as a pitcher could be substituted in place of the glass.

I claim:

1. A drink cooling device for insitu forming of ice in a drinking glass with the top of the container having an ice free region to prevent direct contact of the users lips with the ice formed in the drinking glass comprising:

a drinking glass having a top and a bottom, said drinking glass having a frusto-conical shape with the smaller diameter portion located on the top of said drinking glass, said frusto-conical shape comprising means for retaining an annular ice block therein;

a lid for attachment to the top of said glass, said lid having a lip for frictional engaging and holding said lid on the top of said drinking glass, said lid including an opening for receiving a deformable bottle; and a deformable bottle, said deformable bottle frictionally held in said opening in said lid so that when said lid is placed on said drinking glass it forms an annular cavity between said drinking glass and said deformable bottle so that when water is poured into said annular cavity and allowed to freeze the deformable bottle flexes inward to prevent said drinking glass from breaking due to the expansion of ice during the freezing process.

2. The drink cooler of claim 1 wherein said deformable bottle includes an opening to allow warm liquid to be poured therein to allow for removal of the deformable bottle from the ice located in said drinking glass.

3. The drink cooler of claim 1 including a marking line on said deformable bottle to provide a visual indication as to amount of water to place in said drinking glass so that ice does not form at the top of said drinking glass.

4. The drink cooler of claim 1 including openings in said lid to allow air to escape as water freezes and expands.

5. The drink cooler of claim 1 wherein said drinking glass is made of glass and said deformable bottle is made of polyethylene.

6. The drink cooler of claim 1 wherein the ice formed in said drinking glass is at least 1 and ½ inches away from the top of said drinking glass.

7. A liquid cooling device for insitu forming a layer of ice in a container comprising:

a container having an interior region for holding a liquid to be cooled, said container having an inner surface and a top;

a removable lid for attachment to the top of said container; and a removable member having an exterior surface, said removable member connected to said lid, said removable member extending into said interior region of said container with said inner surface of said container coacting with said exterior surface of said removable member to form a cavity for water between said inner surface of said container and said exterior surface of said removable member so that when water is poured into said cavity and allowed to freeze the water in said cavity freezes into a layer of ice adhering to the inner surface of said container to thereby provide a layer of ice secured to the inner surface of said container so that when the removable lid and member are removed from the container a shell of ice is left adhered to the inside of the container to enable a user to pour a liquid into said container to permit the layer of ice to directly cool the liquid located in said container.

8. The process of insitu forming ice on the inside wall of a container comprising the steps of placing a removable member in a container to form a compartment for freezing water;

pouring water into the compartment;

freezing the water in the compartment to form ice on the inside wall of the container; and removing the removable member from the container without removing the ice to thereby form a cavity formed by the ice for holding a liquid in direct contact with the ice in the container so that the ice dissolves directly into the liquid to cool the liquid.

9. The process of claim 8 including the step of partially filling the compartment with water to thereby leave an ice free region near a top of the container.

10. The process of claim 9, including the step of pouring a warm liquid into the removable member to thereby free the removable member from the ice located in the container.

11. The process of claim 9 including the step of forming a radial inward protrusion in the compartment so that when the water freezes in the compartment the coaction of the container and the protrusion prevent the ice formed in the compartment from floating up when a liquid is placed into the compartment.

* * * * *